United States Patent [19]

Warren

[11] 4,104,767

[45] Aug. 8, 1978

[54] SLIDING CLASP FASTENER

[75] Inventor: David Warren, Sutton Coldfield, England

[73] Assignee: Lightning Fasteners Limited, England

[21] Appl. No.: 727,385

[22] Filed: Sep. 27, 1976

[30] Foreign Application Priority Data

Oct. 22, 1975 [GB] United Kingdom ..... 43361/75

[51] Int. Cl.[2] ..... A44B 19/36

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 1,949,882 | 3/1934 | Rocke | 24/205.11 R |
| 2,289,586 | 7/1942 | Marinsky | 24/205.11 R |
| 2,701,401 | 2/1955 | Dorman | 24/205.11 R |
| 3,110,946 | 11/1963 | Hara | 24/205.11 R |

FOREIGN PATENT DOCUMENTS

| | | | |
|---|---|---|---|
| 697,444 | 11/1964 | Canada | 24/205.11 R |
| 682,960 | 6/1930 | France | 24/205.11 R |
| 2,014,238 | 12/1971 | Fed. Rep. of Germany | 24/205.11 R |
| 542,748 | 5/1956 | Italy | 24/205.11 R |

*Primary Examiner*—Bernard A. Gelak

*Attorney, Agent, or Firm*—Cushman, Darby & Cushman

[57] ABSTRACT

A sliding clasp fastener has a pair of interengageable open-end fittings whereby the fastener stringers may be completely separated one from the other. Each fitting comprises hooking means at each side of a plane parallel to the tapes and transversely opposed surfaces to overlap surfaces of the other fitting.

2 Claims, 3 Drawing Figures

SLIDING CLASP FASTENER

BACKGROUND OF THE INVENTION

This invention relates to a sliding clasp fastener of the open-end type.

The term "open-end type sliding clasp fastener" as used throughout this specification means a sliding clasp fastener which comprises two stringers, each stringer having a series of coupling elements secured to an edge of a carrier tape, the two series of coupling elements being interengaged and disengaged by movement of a slider therealong, and a pair of interengageable releasably connectable end fittings secured one to each of the tapes adjacent the end of its series of elements whereby when the slider has been moved to disengage the two series of elements, said fittings may be disengaged to separate the stringers completely one from the other and then re-engaged to re-assemble the stringers.

SUMMARY OF THE INVENTION

According to the present invention, an open-end type sliding clasp fastener comprises a pair of interengageable open-end fittings, each fitting comprising two hooking means positioned one at each side of a plane which is substantially parallel with the plane of the carrier tapes, the hooking means of the pair of end fittings being mutually engageable in one longitudinal direction, each fitting further comprising transversely opposed surfaces to overlap surfaces of the other fitting so that, when the two series of coupling elements and the pair of end fittings are interengaged, the hooking means prevent separation of the end fittings laterally of the tapes, the transversely opposed surfaces of the end fittings prevent separation thereof transversely to the plane of the tapes, and the interengagement of the coupling elements prevents longitudinal separation in the opposite longitudinal direction.

In one form of the invention the two hooking means of each fitting are offset one from the other so that the sides of the two hooking means provide the transversely opposed surfaces, the offset in the two fittings being in opposite lateral directions when the fittings are interengaged so that the sides of the hooking means of one fitting laterally overlap sides of the hooking means of the other fitting.

In another form of the invention, the two hooking means of each fitting are transversely aligned and extend beyond transversely opposed sides of a rib defined by the fitting towards the other fitting so that, when the fittings are interengaged, sides of the two hooking means of each fitting laterally overlap the sides of the rib of the other fitting.

The invention provides open-end fittings which are particularly suitable for fasteners having series of individual coupling elements moulded onto carrier tapes since the fittings may be moulded in tools which open and close in the same direction as tools employed for moulding the coupling elements. In fact, the tools for the fittings may be actuated simultaneously with the tools for the coupling elements so that the fittings are moulded at the same time as the coupling elements, thereby avoiding separate and subsequent operations to provide open-end fittings on the tapes.

BRIEF DESCRIPTION OF THE DRAWINGS

Two embodiments of the invention will now be described by way of example only with reference to the accompanying drawings in which.

DESCRIPTION OF THE PREFERRED EMBODIMENTS

Figure 1:
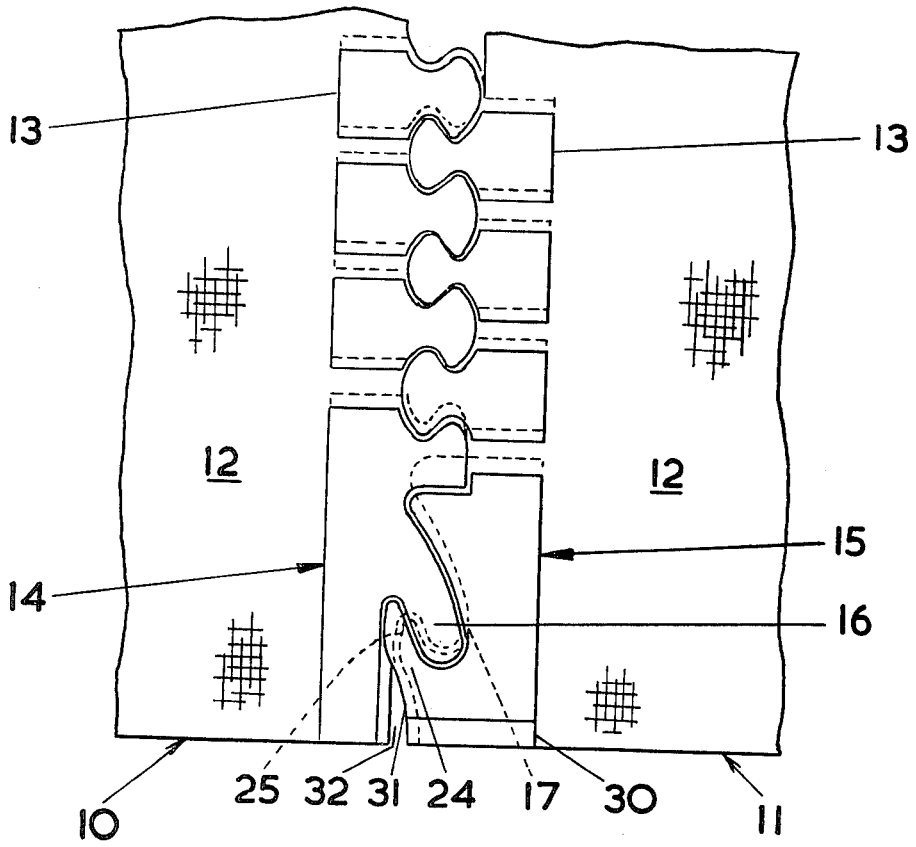
FIG. 1 is a front elevation showing the lower end portion of a sliding clasp fastener having open-end fittings in accordance with the first embodiment.
Figure 2:
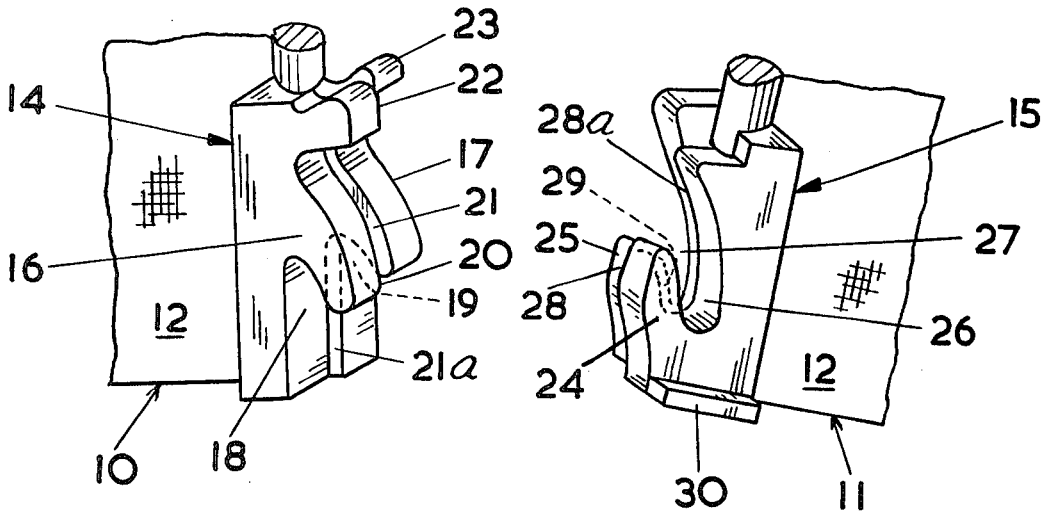
FIG. 2 shows perspective views of the open-end fittings disengaged from one another.

Referring to FIGS. 1 and 2, a sliding clasp fastener comprises two stringers 10 and 11 which each comprise a carrier tape 12 having a series of discrete coupling elements 13 moulded onto one of its edges. The series of elements of the two stringers are interengageable and disengageable by movement of an unshown slider mounted on stringer 11 in well-known manner.

The lower ends of the stringers 10 and 11 carry respective open-end fittings 14 and 15 which are secured to their respective carrier tapes 12 adjacent the lower ends of the series of coupling elements 13. The open-end fittings 14 and 15 may be of plastics or metal, conveniently moulded or cast directly onto the carrier tapes 12, but alternatively they may be made separately and then secured to the tapes, for instance, by welding or clamping.

The open-end fitting 14 comprises hooking means in the form of two hooking portions 16 and 17 which are downwardly directed away from the coupling elements 13 and form two recesses 18 and 19. In this embodiment each hooking portion occupies half the thickness of the open-end fitting 14. The hooking portions 16 and 17 are positioned at each side of a plane coincident with the plane of the carrier tapes 12 with the two hooking portions offset one from the other laterally of the carrier tape to present transversely opposed surfaces 20, 21 and 21*a*.

Above the hooking portions 16 and 17, two laterally extending projections 22 and 23 are appropriately shaped on their upper surfaces to engage with the lowermost coupling element 13 on stringer 11 when the stringers 10 and 11 are assembled.

The open-end fitting 15 comprises hooking means in the form of two hooking portions 24 and 25 upwardly directed towards the coupling elements and forming two recesses 26 and 27. As with the open-end fitting 14, each hooking portion 24 and 25 occupies half of the thickness of the open-end fitting 15 and lies at a respective side of a plane coincident with the plane of the carrier tapes, and the two hooking portions 24 and 25 are offset one from the other laterally of the carrier tape 12 to present transversely opposed surfaces 28, 28*a* and 29. The lower end of the open-end fitting 15 has transversely extending feet 30 (one only being shown) to provide a stop for the slider and prevent it sliding completely off the lower end of the stringer 11. As particularly seen from FIG. 1, the lower end portion of the open-end fitting 15 has a concave edge 31 to provide a clearance 32 from the open-end fitting 14 to enable the lower ends of the open-end fittings 14 and 15 to move towards one another when the slider is located against the feet 30. The offset arrangement of the hooking portions in each open-end fitting, and the shape of the hooking portions and their recesses, are designed to enable the two open-end fittings 14 and 15 to be interengaged as shown in FIG. 1 with the hooking portions 16 and 24 lying at one side of the plane of the carrier tapes 12, and the hooking portions 17 and 25 lying at the other side of the plane of the carrier tapes. Whilst the hooking portions 16, 17:24, 25 prevent separation of the open-end fittings 14 and 15 laterally of the carrier tapes 12, the transversely opposed side surfaces 20, 21, 21*a*:28, 28*a*, 29 laterally overlap one another to prevent separation of the open-end fittings perpendicularly to the plane of the carrier tapes.

The above described open-end fittings are particularly suitable for a fastener of which the coupling elements are moulded between mould parts which move only perpendicularly to the plane of the carrier tapes since the open-end fittings 14 and 15 can be similarly moulded and thus lend themselves to being formed simultaneously with the coupling elements 13. This obviates the need for a separate moulding operation to provide the open-end fittings 14 and 15.

Furthermore, the design of the open-end fittings 14 and 15 enable the stringers 10 and 11 to be assembled in use even when the lower ends of the stringers are not initially correctly aligned; in other words a greater extent of misalignment of the lower ends can be tolerated immediately prior to moving a slider from the open-end fittings to assemble the stringers when compared with conventional open-end type fasteners.

Figure 3:
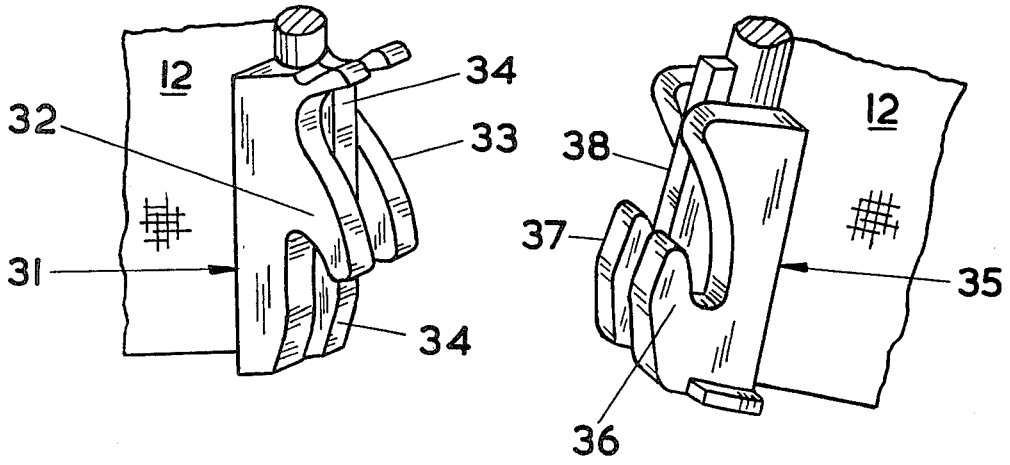
FIG. 3 is similar to FIG. 2 but illustrates the second embodiment.

In the second embodiment illustrated in FIG. 3, an open-end fitting 31 comprises two hooking portions 32 and 33 which, in contrast to those of the first embodiment, are aligned one with the other in a direction perpendicular to the plane of the carrier tape 12 and are spaced-apart by the thickness of a rib 34. Parts of the hooking portions 32 and 33 extend across and beyond opposite sides of the rib 34 away from the associated carrier tape 12 and are positioned at each side of the plane of the carrier tape. Similarly, a cooperating open-end fitting 35 comprises two hooking portions 36 and 37 aligned one with the other in a direction perpendicular to the plane of the carrier tape and spaced-apart by the thickness of a rib 38. Parts of the hooking portions 36 and 37 extend across and beyond opposite sides of the rib 38 away from the associated carrier tape 12 to lie at each side of the plane of the carrier tape.

When the two open-end fittings 31 and 35 are interengaged, the hooking portions of each fitting straddle the rib of the other fitting, and the hooking means of both fittings mutually engage at each side of the tapes with transversely opposed inner surfaces of the hooking portions of one fitting overlapping transversely opposed sides of the rib of the other fitting. Consequently, the hooking portions 32, 33, 36 and 37 prevent separation of the open-end fittings 31 and 35 laterally of the carrier tapes 12, whilst the overlap of the hooking portions 32, 33, 36 and 37 and the ribs 34 and 38 prevent separation of the open-end fittings 31 and 35 perpendicularly to the plane of the carrier tapes 12.

This second embodiment is particularly appropriate for a fastener comprising moulded coupling elements having a slot in their coupling heads adapted to receive the edge of the opposite tape when the fastener is assembled. The mould arrangement for the elements can thus be adopted to provide the space between pairs of hooking portions of each open-end fitting.

In further embodiments not shown in the drawings, the hooking portions of each open-end fitting may be positioned at each side of a plane which is substantially parallel to but is not coincident with the plane of the tapes. Such an arrangement may be employed for example on a fastener of which each stringer has a series of coupling elements secured entirely on one face of a tape. The transversely opposed surfaces may be mutually inclined laterally to the plane of the tapes.

I claim:

1. A sliding clasp fastener comprising two stringers, each stringer having a series of coupling elements secured to an edge of a carrier tape, the two series of coupling elements being interengaged and disengaged by movement of a slider longitudinally of the stringers, and a pair of interengageable releasably connectable end fittings secured one to each of the carrier tapes adjacent an end of the series of coupling elements, each end fitting comprising two hooking means positioned one at each side of a plane which is substantially parallel with a plane of the carrier tapes, both hooking means of the one fitting being directed away from its associated series of coupling elements and forming two recesses to receive the hooking means of the other fitting, both hooking means of the other fitting being directed toward its associated series of coupling elements and forming two recesses to receive the hooking means of said one fitting, the hooking means of the pair of end fittings being mutually engageable in one longitudinal direction, each end fitting further comprising transversely opposed surfaces formed by side surfaces of the hooking means, the two hooking means of each end fitting being offset one from the other so that sides of the two hooking means provide said transversely opposed surfaces, the offset in the two end fittings being in opposite lateral directions when the end fittings are interengaged so that sides of the hooking means of one end fitting laterally overlap sides of the hooking means of the other end fitting, the resulting arrangement being such that, when the two series of coupling elements and the pair of end fittings are interengaged, the hooking means prevent separation of the end fittings laterally of the carrier tapes, the transversely opposed surfaces of the end fittings prevent separation thereof transversely of the plane of the carrier tapes, and the interengagement of the coupling elements prevents longitudinal separation in the opposite longitudinal direction.

2. A sliding clasp fastener comprising two stringers, each stringer having a series of coupling elements secured to an edge of a carrier tape, the two series of coupling elements being interengaged and disengaged by movement of a slider longitudinally of the stringers, and a pair of interengageable releasably connectable end fittings secured one to each of the carrier tapes adjacent an end of the series of coupling elements, each end fitting comprising two hooking means positioned one at each side of a plane which is substantially parallel with a plane of the carrier tapes, both hooking means of the one fitting being directed away from its associated series of coupling elements and forming two recesses to receive the hooking means of the other fitting, both hooking means of the other fitting being directed toward its associated series of coupling elements and forming two recesses to receive the hooking means of said one fitting, the hooking means of the pair of end fittings being mutually engageable in one longitudinal direction, each end fitting further comprising transversely opposed surfaces formed by side surfaces of the hooking means, the two hooking means of each end fitting being transversely aligned and extending beyond transversely opposed sides of a rib defined by the end fitting toward the other end fitting so that, when the end fittings are interengaged, sides of the two hooking means of each end fitting laterally overlap the sides of the rib of the other end fittng, the resulting arrangement being such that, when the two series of coupling elements and the pair of end fittings are interengaged, the hooking means prevent separation of the end fittings laterally of the carrier tapes, the transversely opposed surfaces of the end fittings prevent separation thereof transversely to the plane of the carrier tapes, and the interengagement of the coupling elements prevents longitudinal separation in the opposite longitudinal direction.

* * * * *